United States Patent [19]

Novak et al.

[11] 4,171,979

[45] Oct. 23, 1979

[54] METHOD OF TREATING SCRATCHED OR ABRADED PHOTOGRAPHIC ELEMENTS WITH RADIATION-CURABLE COMPOSITIONS COMPRISING AN ACRYLATED URETHANE, AN ALIPHATIC ETHYLENICALLY-UNSATURATED CARBOXYLIC ACID AND A MULTIFUNCTIONAL ACRYLATE

[75] Inventors: Carl P. Novak; Edward D. Morrison; Gerald M. Leszyk, all of Rochester, N.Y.

[73] Assignee: Eastman Kodak Company, Rochester, N.Y.

[21] Appl. No.: 902,576

[22] Filed: May 4, 1978

Related U.S. Application Data

[63] Continuation-in-part of Ser. No. 737,445, Nov. 1, 1976, Pat. No. 4,092,173.

[51] Int. Cl.[2] ..... G03C 1/00

[52] U.S. Cl. ..... 96/119 R; 427/44; 96/86 P; 96/87 R

[58] Field of Search ..... 96/119 R, 86 P, 50 PL, 96/35.1; 427/44; 204/159.19, 159.23, 159.16

[56] References Cited

U.S. PATENT DOCUMENTS

| | | | |
|---|---|---|---|
| 2,948,611 | 8/1960 | Barney | 96/35.1 X |
| 3,140,270 | 7/1964 | Thoma et al. | 96/115 |
| 3,689,307 | 9/1972 | Johnson et al. | 427/44 |
| 3,689,310 | 9/1972 | Johnson et al. | 427/44 |
| 3,719,522 | 3/1973 | Johnson et al. | 427/44 |
| 3,907,574 | 9/1975 | Yonezawa et al. | 96/115 R X |

*Primary Examiner*—John D. Welsh

[57] ABSTRACT

Photographic elements, such as still films, motion picture films, paper prints, microfiche, and the like, which have defects such as scratches, abrasion marks and the like, which impair the appearance or projection capabilities of the element are treated with a restorative composition which fills in the defects so as to effectively eliminate them and restore the element to a substantially defect-free condition. The restorative composition which is applied to the photographic element is a radiation-curable composition comprising an acrylated urethane, an aliphatic ethylenically-unsaturated carboxylic acid and a multifunctional acrylate. It is applied to the element, at least in the region of the defect being treated, and, is then subjected to radiation, such as, for example, ultraviolet light irradiation or high energy electron bombardment, sufficient to bond it to the element and cure it to a transparent, flexible, scratch-resistant, cross-linked polymeric material.

20 Claims, No Drawings

METHOD OF TREATING SCRATCHED OR ABRADED PHOTOGRAPHIC ELEMENTS WITH RADIATION-CURABLE COMPOSITIONS COMPRISING AN ACRYLATED URETHANE, AN ALIPHATIC ETHYLENICALLY-UNSATURATED CARBOXYLIC ACID AND A MULTIFUNCTIONAL ACRYLATE

This application is a continuation-in-part of application Ser. No. 737,445, now U.S. Pat. No. 4,092,173, "Photographic Elements Coated With Protective Overcoats", Carl P. Novak, Edward D. Morrison and Gerald M. Leszyk, filed Nov. 1, 1976 and issued May 30, 1978, as U.S. Pat. No. 4,092,173.

This invention relates in general to the photographic art and in particular to a method of treating a photographic element, having defects therein which impair its appearance or projection capabilities, to restore the element to a substantially defect-free condition. More specifically, this invention relates to the application of a radiation-curable composition to photographic elements, such as still films, motion picture films, paper prints, microfiche, and the like, having defects such as scratches, abrasion marks, and the like, on one or both sides thereof, to fill in such defects and thereby effectively eliminate them. The radiation-curable composition can be applied locally in the region of the defects only or it can be applied over the entire surface of the element to both eliminate the defects and form a protective overcoat layer that is capable of providing protection against subsequent scratching or abrasion.

Photographic elements having protective overcoat layers are well known and a wide variety of different coating compositions have been proposed in the past for use as protective overcoats. Such overcoats serve a number of different purposes, such as to provide protection against fingerprints, abrasion and scratching, to protect against water spotting, to provide a particular surface texture such as a matte surface, to provide protection against blocking, and to act as anti-reflection layers which reduce glare. Layers of a temporary nature which are intended to be removed after they have served their purpose and layers which are permanently bonded to the photographic element have been described in the prior art. Protective overcoats can be applied to photographic elements by coating solutions or dispersions of film-forming agents in organic solvents such as are described, for example, in U.S. Pat. Nos. 2,259,009; 2,331,746; 2,706,686; 3,113,867; 3,190,197 and 3,415,670; by coating of aqueous film-forming compositions such as are described, for example, in U.S. Pat. Nos. 2,173,480; 2,798,004; 3,502,501 and 3,733,293; by coating of compositions containing discrete, transparent, solid particles of submicroscopic size as described in U.S. Pat. No. 2,536,764; by coating of plasticized polymer compositions as described in U.S. Pat. No. 3,443,946; by coating of polymerized perfluorinated olefins as described in U.S. Pat. No. 3,617,354; and by lamination of a protective layer as described, for example, in U.S. Pat. Nos. 3,397,980 and 3,697,277.

Protective overcoats known heretofore have suffered from various disadvantages which have greatly limited their usefulness. For example, though numerous types of overcoats have been proposed, none has been fully satisfactory in providing abrasion and scratch resistance for photographic elements which are commonly subjected to severe conditions in handling and use, such as microfiche and motion picture films. Protective overcoats for such elements must meet exacting requirements with respect to factors such as transparency and flexibility as well as abrasion resistance and scratch resistance, and must be very strongly bonded to the underlying material to avoid the possibility of delamination. Protective overcoats meeting all of these requirements have long been sought without success. Moreover, many of the compositions proposed heretofore for use as overcoats are not effective as restorative compositions for treating elements which have been subjected to scratching or abrasion in use.

In U.S. patent application Ser. No. 737,445 filed Nov. 1, 1976, of which the present application is a continuation-in-part, there is disclosed a photographic element having on one or both sides thereof a protective overcoat that has been formed by coating the element with a radiation-curable composition comprising an acrylated urethane, an aliphatic ethylenically-unsaturated carboxylic acid and a multifunctional acrylate, and irradiating the coating to bond it to the element and cure it to form a transparent, flexible, scratch-resistant, cross-linked polymeric layer. The present application relates to utilization of this radiation-curable composition to treat a photographic element having defects therein which impair its appearance or projection capabilities, such as scratches, abrasion marks, and the like, to effectively eliminate them and restore the element to a substantially defect-free condition. The radiation-curable composition can be applied to the element locally in the region of the defects only. Alternatively, it can be applied over the entire surface of the element to both eliminate the defects and form a protective overcoat layer that is capable of providing protection against subsequent scratching or abrasion. In either case, radiation curing of the composition by, for example, the use of ultraviolet radiation or high energy electrons, results in the formation of a transparent, flexible, scratch-resistant, cross-linked polymeric material which is strongly bonded to the photographic element.

The radiation-curable compositions disclosed in application Ser. No. 737,445 can be used in treating scratches, abrasion marks, and similar defects in many different types of photographic elements. For example, the photographic elements can be still films, motion picture films, paper prints, or microfiche. They can be black-and-white elements, color elements formed from a negative in a negative - positive process, or color elements formed directly by a reversal process. Radiation curing of the composition has been found, quite surprisingly, to provide strong bonding to all of these different types of photographic element without in any way adversely affecting the element itself. The photographic elements can comprise any of a wide variety of supports. Typical supports include cellulose nitrate film, cellulose acetate film, poly(vinyl acetal) film, polystyrene film, poly(ethylene terephthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(-vinylpyrrolidone), acrylamide polymers, and the like. A particularly common example of an image-forming layer is a gelatino/silver halide emulsion layer and the compositions described herein provide excellent results in treating defects in and providing protective overcoats for such emulsion layers.

The method of treatment described herein is especially advantageous with motion picture films. Thus, for example, motion picture print film often becomes badly scratched after it has been run through projectors many times. It must then be discarded even though other characteristics may still be acceptable. Use of the restorative coating compositions described herein is highly effective in alleviating scratches that would blemish the projected image and thus the scratched film can be restored to useful service. The method of this invention is particularly effective with scratches on the support side, which is where scratches most frequently occur on motion picture film. However, the restorative coating compositions described herein will also provide significant improvement with regard to scratches on the image side if such scratches are not too deep.

The first essential ingredient in the radiation-curable compositions employed in the practice of this invention is an acrylated urethane. The acrylated urethane can be a monomer, oligomer or polymer, or mixtures thereof. The acrylated urethanes are well known materials which have been used heretofore in radiation-curable compositions. Materials of this type are described, for example, in U.S. Pat. Nos. 3,509,234; 3,600,539; 3,694,415; 3,719,638 and 3,775,377 and in British Pat. No. 1,321,372. The acrylated urethanes are readily cross-linked by application of suitable radiation and are particularly advantageous in the coating compositions of this invention in that they form a very hard and very abrasion-resistant material upon curing. In a preferred embodiment of the invention, the acrylated urethane is prepared by reaction of a diisocyanate, such as tolylene diisocyanate, with a saturated aliphatic diol, such as 1,4-butane diol or neopentylglycol, and then with an unsaturated alcohol, such as 2-hydroxyethyl acrylate.

The second essential ingredient of the radiation-curable composition is an aliphatic ethylenically-unsaturated carboxylic acid. Acids of this type act as effective adhesion promoters in the compositions employed herein. Typical examples of this class of acids are acrylic acid, methacrylic acid, 3-chloro-2-methyl acrylic acid, 3-butenoic acid, 4-pentenoic acid, 2-hexenoic acid, and the like. Preferred acids are those of the formula:

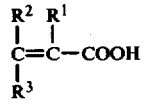

where $R^1$, $R^2$ and $R^3$ are hydrogen atoms or alkyl groups of 1 to 3 carbon atoms; while acrylic acid is especially preferred.

The third essential ingredient of the radiation-curable composition is a multifunctional acrylate, i.e., an acrylic monomer comprising at least two acrylic ester groups. Monomers of this class function in the radiation-curable compositions to increase hardness of the coating, improve adehsion and promote fast curing. Typical examples of this class of acrylic monomers are:

neopentylglycol diacrylate,
pentaerythritol triacrylate,
1,6-hexanediol diacrylate,
trimethylolpropane triacrylate
tetraethylene glycol diacrylate,
1,3-butylene glycol diacrylate,
trimethylolpropane trimethacrylate,
1,3-butylene glycol dimethacrylate,
ethylene glycol dimethacrylate,
pentaerythritol tetraacrylate,
tetraethylene glycol dimethacrylate,
1,6-hexanediol dimethacrylate,
ethylene glycol diacrylate,
diethylene glycol diacrylate,
glycerol diacrylate,
glycerol triacrylate,
1,3-propanediol diacrylate,
1,3-propanediol dimethacrylate,
1,2,4-butanetriol trimethacrylate,
1,4-cyclohexanediol diacrylate,
1,4-cyclohexanediol dimethacrylate,
pentaerythritol diacrylate,
1,5-pentanediol dimethacrylate, and the like.

Preferred multifunctional acrylates are those of the formula:

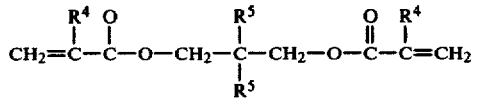

where each $R^4$ is independently selected from the group consisting of a hydrogen atom and an alkyl group of 1 to 2 carbon atoms, each $R^5$ is independently selected from the group consisting of an alkyl group of 1 to 6 carbon atoms and a radical of the formula:

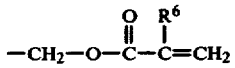

in which $R^6$ is a hydrogen atom or an alkyl group of 1 to 2 carbon atoms.

As explained hereinabove, the radiation-curable compositions used in the practice of this invention are compositions containing (1) an acrylated urethane, (2) an aliphatic ethylenically-unsaturated carboxylic acid, and (3) a multifunctional acrylate. Mixtures of two or more acrylated urethanes, of two or more aliphatic ethylenically-unsaturated carboxylic acids and of two or more multifunctional acrylates can be used, if desired, and may be advantageous in particular instances. Other ingredients can also be incorporated in the radiation-curable composition, for example, monoacrylates such as ethyl acrylate, butyl acrylate, 2-ethylhexyl acrylate and hydroxypropyl acrylate can be used to modify the viscosity of the composition, and acrylamide can be used as an adhesion promoter.

The proportions of each of the three essential components of the radiation-curable coating compositions can be varied widely, as desired. Typically, the acrylated urethane is used in an amount of from about 4 to about 60% of the total composition on a weight basis, the aliphatic ethylenically-unsaturated carboxylic acid is used in an amount of from about 1 to about 20% of the total composition on a weight basis, and the multifunctional acrylate is used in an amount of from about 20 to about 95% of the total composition on a weight basis. The optimum amounts to use in a particular instance will depend upon the particular compounds involved and upon the characteristics of the photographic element which is being coated with the radiation-curable formulation. High concentrations of the aliphatic ethylenically-unsaturated carboxylic acid should usually be avoided in any coating composition which is to be in contact with a gelatin-containing layer of a photographic element as they can adversely affect such layers since the acid may attack the gelatin. Particularly preferred compositions, in view of the excellent combination of transparency, hardness, scratch resistance, abrasion resistance, flexibility and adhesion achieved therewith, are compositions comprised of an acrylated urethane, acrylic acid, trimethylolpropane triacrylate and neopentylglycol diacrylate. Use of the mixture of multifunctional acrylates, namely the combination of trimethylolpropane triacrylate and neopentylglycol diacrylate, is especially advantageous in that the trimethylolpropane triacrylate is particularly effective in providing good adhesion and the neopentylglycol diacrylate is particularly effective as a hardening monomer which gives increased scratch resistance without sacrificing flexibility.

In the practice of this invention, the particular ingredients and proportion of ingredients in the coating composition that will provide the best results is dependent on the composition of the photographic element. For example, the particular coating compositions which will provide optimum adehsion depend on the particular binder used in the image-bearing layer(s) or, if the element is to be coated on the support side, the particular material used as a support. Generally speaking, it is much easier to obtain adequate adhesion to the support than to obtain adequate adhesion to the image-bearing layer(s). A few simple experiments may be found to be necessary to formulate an optimum coating composition for any particular photographic element.

The photographic elements which are treated in accordance with this invention are elements which have been exposed and processed to form a visible image and which, during exposure or processing or more usually during subsequent use, have been abraded or scratched or otherwise treated in a manner to impart defects which impair their appearance or projection capabilities. Such processing can be carried out in any suitable manner. For example, black-and-white elements are typically processed in a sequence of steps comprising developing, fixing and washing, color prints in a sequence comprising color developing, bleaching, fixing (or combined bleach-fixing) and stabilizing, and color reversal elements in a sequence comprising black-and-white negative development, followed by reversal exposure or fogging, color development, bleaching, fixing (or combined bleach-fixing) and stabilizing. While scratches or abrasion marks can be incurred in exposure and/or processing, the more typical situation is a gradual accumulation of such defects as a result of use of the element. Thus, the normal use of exposed and processed elements, for example, use of a motion picture film in a projector or of a microfiche in a reader, commonly results in the formation of the kinds of defects which can be removed or at least diminished by the method of this invention.

As disclosed hereinabove, in carrying out the method of this invention the radiation-curable composition is applied to the photographic element at least in the region of the element in which the defects are located. It can be applied only to such region, since local application to the defects by suitable means such as a brush or other type of applicator can be utilized, if desired. It will usually be much easier and more convenient, since there will be many small scratches and abrasion marks on the photographic element, to apply the radiation-curable composition over the entire surface or surfaces of the element where the defects appear. In following the latter procedure, coating of the photographic element with the radiation-curable composition can be carried out in any convenient manner. For example, it can be carried out by dip coating, airknife coating, roll coating, gravure coating, extrusion coating, bead coating, curtain coating, use of wire wound coating rods, and so forth. Typically, the coating deposited on the element will be a very thin coating such as a wet coverage in the range from about 2 to about 20 cubic centimeters of coating composition per square meter of surface coated, more usually in the range from about 3 to about 10 cubic centimeters of coating composition per square meter, and preferably about 5 cubic centimeters of coating composition per square meter.

The viscosity of the radiation-curable composition used to treat the photographic element must be sufficiently low that it is able to fill in the scratch or other defect. In other words, the viscosity must not be so high that the composition applied bridges over a scratch with the result that the scratch will remain as a visible defect beneath the transparent cured polymeric material. The optimum viscosity will depend on numerous factors such as the type of element being treated, the method of application of the composition, and the width and depth of the scratch. Typically, viscosities in the range from about 5 to about 600 centipoises are useful, with the preferred range being from about 10 to about 100 centipoises, and the most preferred range being from about 30 to about 40 centipoises.

Apparatus and methods for curing of radiation-curable compositions by subjecting them to suitable forms of radiation are well known and any suitable radiation curing process can be used in carrying out this invention. For example, curing can be carried out by the application of ultraviolet radiation of suitable intensity. High energy ionizing radiation such as X-rays, gamma rays, beta rays and accelerated electrons can also be used to accomplish curing of the coating. Typically, the radiation used should be of a sufficient intensity to penetrate substantially all the way through the coated layer. The total dosage employed should be sufficient to bring about curing of the radiation-curable composition to form a solid plastic. Typically, dosages in the range of about 0.2 to about 50 megarads, more usually in the range from about 0.5 to about 20 megarads, are employed. The coating compositions used in this invention are substantially completely convertible to a solid product so that the removal of solvent or diluents during the curing step is not necessary. Furthermore, they undergo little or no shrinkage upon curing. Accordingly, when the scratch is completely filled in by the radiation-curable composition it remains completely filled in after the curing step is completed.

When the radiation-curable composition is cured by the use of ultraviolet radiation, a photoinitiator should be included in the composition. Many photoinitiators which are useful for such purpose are known to the art, for example, butyl benzoin ether, isobutyl benzoin ether, ethyl benzoin ether, benzophenone, benzoin, acetophenone dimethyl quinoxiline, 4,4'-bis(dimethylamino)benzophenone, and the like. Such photoinitiators may be used singly or in combination. The use of photoinitiators is not necessary when curing is carried out with high energy electrons.

The radiation-curable compositions described herein adhere strongly to both the image-bearing side and the support side of photographic elements, and, accordingly, are effective in treating scratches, abrasion marks, and other defects on either or both of the image-bearing side and the support side. They are effective in providing adhesion to materials with which it is ordinarily difficult to achieve adhesion, such as the cellulose triacetate or poly(ethylene terephthalate) which are commonly used as support materials for photographic elements and the gelatino/silver halide emulsion layers or gelatin protective layers commonly employed on the image-bearing side of photographic elements. Irradiation of the composition to cure it to a transparent, flexible, scratch-resistant, cross-linked polymeric material can be carried out with no significant detrimental effect on the image-bearing layer(s), even with color elements in which the images are dye images.

The invention is further illustrated by the following examples of its practice.

EXAMPLE 1

An acrylated urethane was prepared by dissolving tolylene diisocyanate (TDI) and neopentylglycol (NPG) in neopentylglycol diacrylate and heating the resulting solution at 65° C. for 4 hours, then adding 2-hydroxyethyl acrylate (HEA) and reacting for 6 hours in the presence of dibutyl tin dilaurate as a catalyst. The molar ratio of TDI:NPG:HEA was 1.0:0.5:0.8. The acrylated urethane produced by this method has the following structure:

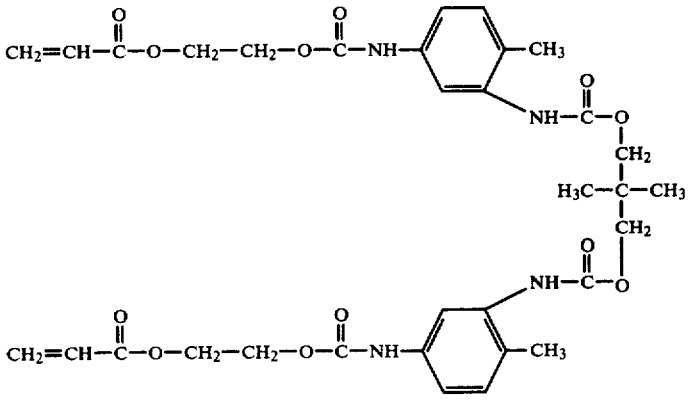

A radiation-curable coating composition containing the acrylated urethane described above was prepared with the following composition:

| Component | Weight % |
|---|---|
| Acrylated urethane | 10.1 |
| Neopentylglycol diacrylate | 42.4 |
| Trimethylolpropane triacrylate | 31.2 |
| Tetraethyleneglycol diacrylate | 2.4 |
| Acrylic acid | 7.2 |
| Fluorocarbon coating aid | 0.2 |
| Methyldiethanol amine | 2.5 |
| Benzophenone | 4.0 |

A 35 mm color print motion picture film having a poly(ethylene terephthalate) support and gelatino/silver halide emulsion layers was exposed and processed to a visible image and then scratched on the support side with a synthetic fiber cleaning pad to give a random distribution of scratches of different lengths, widths and depths. The scratched side of the film was coated over its entire surface with the radiation-curable composition described above. Curing of the coating was carried out by passing the film at a rate of 45 feet per minute through a curing oven containing three 200 watt/inch high intensity medium pressure mercury vapor UV lamps. Curing of the coating resulted in the formation of a transparent, flexible, scratch-resistant, cross-linked polymeric layer which was strongly bonded to the support. The coating completely filled in the scratches so they were no longer visible. The coefficient of friction of the cross-linked polymeric coating was substantially the same as that of the poly(ethylene terephthalate) support. To evaluate the effectiveness of the coating, the coated film was run through a motion picture projector and the overall appearance of the projected image was found to be excellent, with the scratches no longer being visible.

EXAMPLE 2

A color print motion picture film having a cellulose triacetate film support and gelatino/silver halide emulsion layers was exposed and processed to a visible image and then scratched on the support side in the same manner as described in Example 1. Both sides of the film were then coated with the following radiation-curable composition:

| Component | Weight % |
|---|---|
| Acrylated urethane of Example 1 | 8.7 |
| Trimethylolpropane triacrylate | 38.4 |
| Acrylic acid | 9.6 |
| Neopentylglycol diacrylate | 37.2 |
| Benzophenone | 3.8 |
| Methyldiethanol amine | 2.3 |

Curing of the coatings was carried out by passing the film under a bank of three 200 watt/inch high intensity mercury vapor UV lamps at a distance of 12 inches and resulted in the formation of transparent, flexible, scratch-resistant, cross-linked polymeric layers strongly bonded to both the support side and the image side of the motion picture film. The coating on the support side completely filled in the scratches so they were no longer visible. To evaluate the effectiveness of the coating, the coated film was run through a motion picture projector and the overall appearance of the projected image was found to be excellent, with the scratches no longer being visible.

The invention has been described in detail with particular reference to preferred embodiments thereof, but it will be understood that variations and modifications can be effected within the spirit and scope of the invention.

We claim:

1. A method of treating a photographic element comprising a support and at least one image-bearing layer, said element having defects such as scratches, abrasion marks and the like on one or both sides thereof which impair the appearance or projection capabilities of said element, which method comprises (a) applying to said element, at least in the region of said element in which said defects are located, a radiation-curable composition which fills in said defects and forms a transparent, flexible, scratch-resistant, cross-linked polymeric material upon radiation curing, said composition comprising (1) an acrylated urethane, (2) an aliphatic ethylenically-unsaturated carboxylic acid, and (3) a multifunctional acrylate, and (b) subjecting said composition to radiation sufficient to cure it and bond it to said element, whereby the adverse effects of said defects on the appearance or projection capabilities of said element are reduced or eliminated.

2. A method as claimed in claim 1 wherein said aliphatic ethylenically-unsaturated carboxylic acid has the formula:

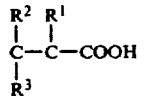

wherein $R^1$, $R^2$ and $R^3$ are independently selected from the group consisting of a hydrogen atom and an alkyl group of 1 to 3 carbon atoms.

3. A method as claimed in claim 1 wherein said aliphatic ethylenically-unsaturated carboxylic acid is acrylic acid.

4. A method as claimed in claim 1 wherein said multifunctional acrylate has the formula:

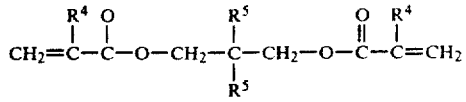

wherein each $R^4$ is independently selected from the group consisting of a hydrogen atom and an alkyl group of 1 to 2 carbon atoms, and each $R^5$ is independently selected from the group consisting of an alkyl group of 1 to 6 carbon atoms and a radical of the formula

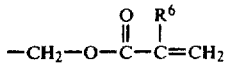

in which $R^6$ is a hydrogen atom or an alkyl group of 1 to 2 carbon atoms.

5. A method as claimed in claim 1 wherein said multifunctional acrylate is trimethylolpropane triacrylate.

6. A method as claimed in claim 1 wherein said multifunctional acrylate is pentaerythritol tetraacrylate.

7. A method as claimed in claim 1 wherein said multifunctional acrylate is neopentylglycol diacrylate.

8. A method as claimed in claim 1 wherein said acrylated urethane has the formula:

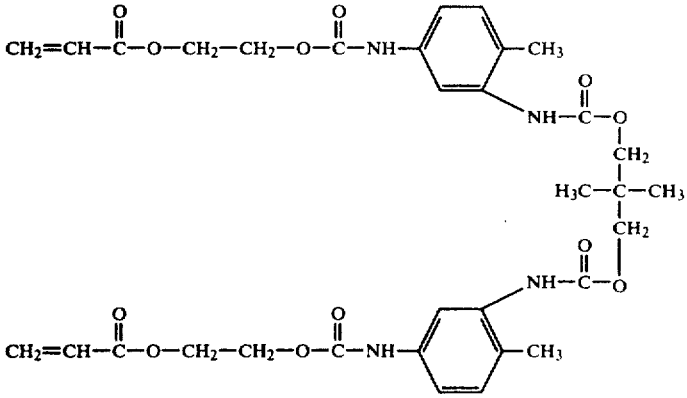

9. A method as claimed in claim 1 wherein said radiation-curable composition comprises an acrylated urethane, acrylic acid, trimethylolpropane triacrylate and neopentylglycol diacrylate.

10. A method as claimed in claim 1 wherein said radiation-curable composition consists essentially of about 10% by weight acrylated urethane, about 10% by weight acrylic acid, about 40% by weight trimethylolpropane triacrylate and about 40% by weight neopentylglycol diacrylate.

11. A method as claimed in claim 1 wherein said radiation-curable composition has a viscosity in the range of from about 10 to about 100 centipoises.

12. A method as claimed in claim 1 wherein said radiation-curable composition is applied only to the region of said element in which said defects are located.

13. A method as claimed in claim 1 wherein said radiation-curable composition covers at least one entire surface of said element.

14. A method as claimed in claim 1 wherein said support is a cellulose triacetate support and said image-bearing layer is an imagewise-exposed and processed gelatino/silver halide emulsion layer.

15. A method as claimed in claim 1 wherein said support is a poly(ethylene terephthalate) support and said image-bearing layer is an imagewise-exposed and processed gelatino/silver halide emulsion layer.

16. A method as claimed in claim 1 wherein said support is a polyethylene-coated paper support and said image-bearing layer is an imagewise-exposed and processed gelatino/silver halide emulsion layer.

17. A method of treating a photographic motion picture film comprising a poly(ethylene terephthalate) support and at least one imagewise-exposed and processed gelatino/silver halide emulsion layer, said film having scratches in said support which impair its projection capabilities, which method comprises (a) coating said support with a radiation-curable composition which fills in said scratches and forms a transparent, flexible, scratch-resistant, cross-linked polymeric layer upon radiation curing, said composition comprising (1) an acrylated urethane, (2) an aliphatic ethylenically-unsaturated carboxylic acid, and (3) a multifunctional acrylate, and (b) subjecting said coating to radiation sufficient to cure it and bond it to said support, whereby the adverse effects of said scratches on the projection capabilities of said film are reduced or eliminated.

18. A method of treating a photographic motion picture film comprising a cellulose triacetate support and at least one imagewise-exposed and processed gelatino/silver halide emulsion layer, said film having scratches in said support which impair its projection capabilities, which method comprises (a) coating said support with a radiation-curable composition which fills in said scratches and forms a transparent, flexible, scratch-resistant, cross-linked polymeric layer upon radiation curing, said composition comprising (1) an acrylated urethane, (2) an aliphatic ethylenically-unsaturated carboxylic acid, and (3) a multifunctional acrylate, and (b) subjecting said coating to radiation sufficient to cure it and bond it to said support, whereby the adverse effects of said scratches on the projection capabilities of said film are reduced or eliminated.

19. The method of claim 17 wherein said radiation-curable composition is applied at a wet coverage in the range of from about 3 to about 10 cubic centimeters of coating composition per square meter of support.

20. The method of claim 18 wherein said radiation-curable composition is applied at a wet coverage in the range of from about 3 to about 10 cubic centimeters of coating composition per square meter of support.

* * * * *